US005626068A

United States Patent [19]

Davies

[11] Patent Number: 5,626,068

[45] Date of Patent: May 6, 1997

[54] HYDRAULIC RECIPROCATING MECHANISM

[75] Inventor: Michael R. Davies, Norwood, South Africa

[73] Assignee: White Manufacturing (Proprietary) Limited, New Era Springs, South Africa

[21] Appl. No.: 417,020

[22] Filed: Apr. 5, 1995

[30] Foreign Application Priority Data

Apr. 12, 1994 [ZA] South Africa ..... 94/2503

[51] Int. Cl.[6] ..... F01B 7/18

[52] U.S. Cl. ..... 91/235; 91/276; 91/300

[58] Field of Search ..... 91/235, 276, 298, 91/300

[56] References Cited

U.S. PATENT DOCUMENTS

| | | | |
|---|---|---|---|
| Re. 30,109 | 10/1979 | Bouyoucos et al. . | |
| 1,737,456 | 11/1929 | Gartin | 91/235 |
| 3,822,633 | 7/1974 | Ottestad | 91/224 |
| 4,005,637 | 2/1977 | Bouyoucos et al. | 91/276 |
| 4,028,995 | 6/1977 | Salmi et al. | 91/276 |
| 4,084,486 | 4/1978 | Juvonen | 91/276 |
| 5,222,425 | 6/1993 | Davies | 91/276 |

FOREIGN PATENT DOCUMENTS

| | | |
|---|---|---|
| 2520323 | 11/1976 | Germany . |
| 81/4749 | 7/1981 | South Africa . |
| 83/6780 | 9/1983 | South Africa . |
| 84/9716 | 12/1984 | South Africa . |
| 91/10187 | 8/1992 | South Africa . |
| 92/5617 | 3/1993 | South Africa . |

*Primary Examiner*—F. Daniel Lopez

*Attorney, Agent, or Firm*—Oblon, Spivak, McClelland, Maier & Neustadt, P.C.

[57] ABSTRACT

The hydraulic reciprocating mechanism has a housing and a piston located reciprocably in the housing. The piston and housing define a supply chamber and a return chamber. The return chamber has valve seats at either end. There is an inlet to the supply chamber for pressurized hydraulic fluid and an exhaust outlet from the return chamber. An interconnecting passage extends between the supply chamber and the return chamber. A single popper valve is located reciprocably in the return chamber and is moved by hydraulic forces between positions in which it seats on the respective valve seats. In one position of the popper valve it closes the exhaust outlet and opens the interconnecting passage to admit hydraulic fluid from the supply chamber to the return chamber. This has the result hydraulic fluid in the return chamber drives the piston in one direction. In another position of the poppet valve, it closes the interconnecting passage and opens the exhaust outlet, allowing hydraulic fluid to be exhausted from the return chamber by the piston as the piston is driven the opposite direction by hydraulic fluid in the supply chamber.

8 Claims, 5 Drawing Sheets

28
27
30
33
32
19
29
6b
31
15
18
17
25
23
22
24
8
9
26
11
26
13
12

HYDRAULIC RECIPROCATING MECHANISM

BACKGROUND TO THE INVENTION

1. Field of the Invention

This invention relates to hydraulic reciprocating mechanisms.

2. Discussion of the Background

In one application, such mechanisms are used in the mining industry, in rock drills, to apply repeated impacts to the end of a drill steel.

In this application it is desirable, due its ready availability, to use pressurized mine grade water to drive the hydraulic reciprocating mechanism. However, many existing hydraulic reciprocating mechanisms utilize spool valves which are adversely affected by the use of mine grade water for their operation due to the solid particles in this type of water.

SUMMARY OF THE INVENTION

According to the invention there is provided an hydraulic reciprocating mechanism comprising:

housing;

a piston located reciprocably in the housing and defining, with the housing, a supply chamber and a return chamber, the return chamber having respective first and second ends and the piston presenting exposed, differential piston areas on which hydraulic forces act, during operation of the mechanism, to cause reciprocation of the piston;

an inlet to the supply chamber for pressurised hydraulic fluid;

an exhaust outlet from the return chamber;

an interconnecting passage extending between the supply chamber and the return chamber; and a single poppet valve which is located reciprocably in the return chamber for movement, under the influence of hydraulic forces, between:

a first position in which the poppet valve seats against the first end of the return chamber so as to close the exhaust outlet and open the interconnecting passage to admit hydraulic fluid from the supply chamber to the return chamber with the result that the hydraulic fluid in the return chamber drives the piston in a first direction; and a second position in which the poppet valve seats against the second end of the return chamber so as to close the interconnecting passage and open the exhaust outlet to allow hydraulic fluid to be exhausted from the return chamber by the piston as the piston is driven in a second direction, opposite to the first direction, by hydraulic fluid in the supply chamber.

Typically, the arrangement is such that the poppet valve is moved, by hydraulic forces acting on it, from its first position to its second position as the piston approaches the end of a stroke in the first direction and from its second position to its first position as the piston approaches the end of a stroke in the second direction.

In the preferred embodiment, the poppet valve is annular in shape and surrounds the piston, an outer surface of the popper valve being exposed continuously to the pressure of hydraulic fluid at the inlet and the external shape of the popper valve being such that it experiences an hydraulic force, due to the pressure of hydraulic fluid at the inlet, tending to move it from its first position to its second position. In this embodiment:

the supply chamber includes a supply zone in direct communication with the inlet and an intermediate zone connected to the return chamber by the interconnecting passage, the housing defines an annular constriction between the supply and intermediate zones, and a section of the piston is arranged to make a close or sealing fit with the annular constriction as the piston approaches the end of its stroke in the first direction, with the result that, with further movement of the piston in the first direction, there is a reduction in hydraulic pressure in the intermediate zone of the supply chamber and in the return chamber, such pressure reduction causing a pressure differential across the poppet valve which urges the poppet valve from its first position to its second position.

According to further preferred features:

the internal surface of the popper valve defines an annular constriction about the piston with respective portions of the return chamber being defined between the first end of the return chamber and the constriction and between the second end of the return chamber and the constriction, and a section of the piston makes a close fit in the constriction when the piston approaches the end of its stroke in the second direction, with the result that hydraulic pressure increases in that portion of the return chamber defined between the second end thereof and the constriction, such pressure increase urging the popper valve to move from its second position to its first position.

In one application of the invention, the mechanism described above is incorporated in a rock drill, the piston being arranged to strike the end of a drill steel on its stroke in the second direction and to withdraw from the drill steel on its stroke in the first direction.

BRIEF DESCRIPTION OF THE DRAWINGS

The invention will now be described in more detail, by way of example only, with reference to the accompanying drawings in which.

DESCRIPTION OF THE PREFERRED EMBODIMENT

Figure 1:
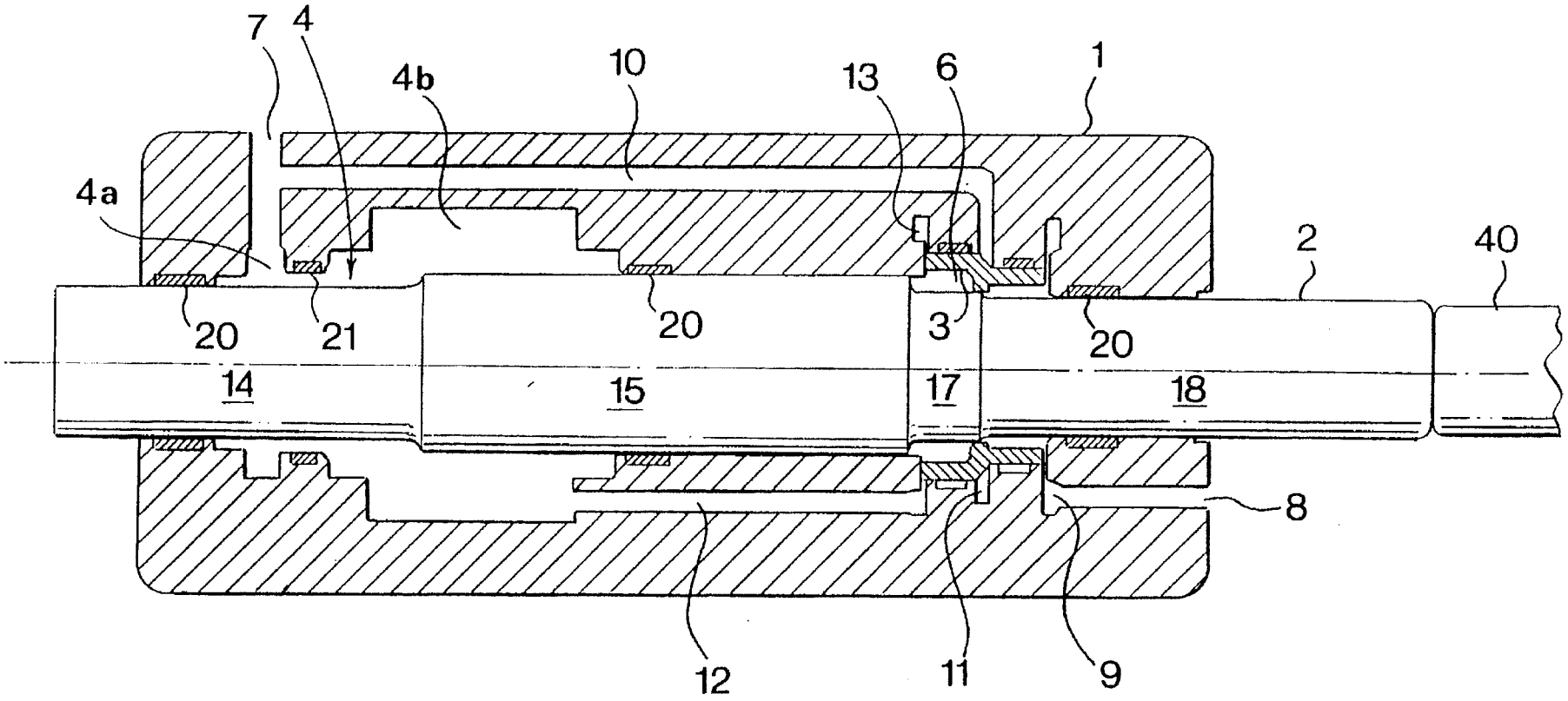
FIG. 1 shows a cross-sectional view of a reciprocating mechanism according to the invention with the piston at the end of its forward stroke, i.e. a stroke in the second direction.
Figure 5:
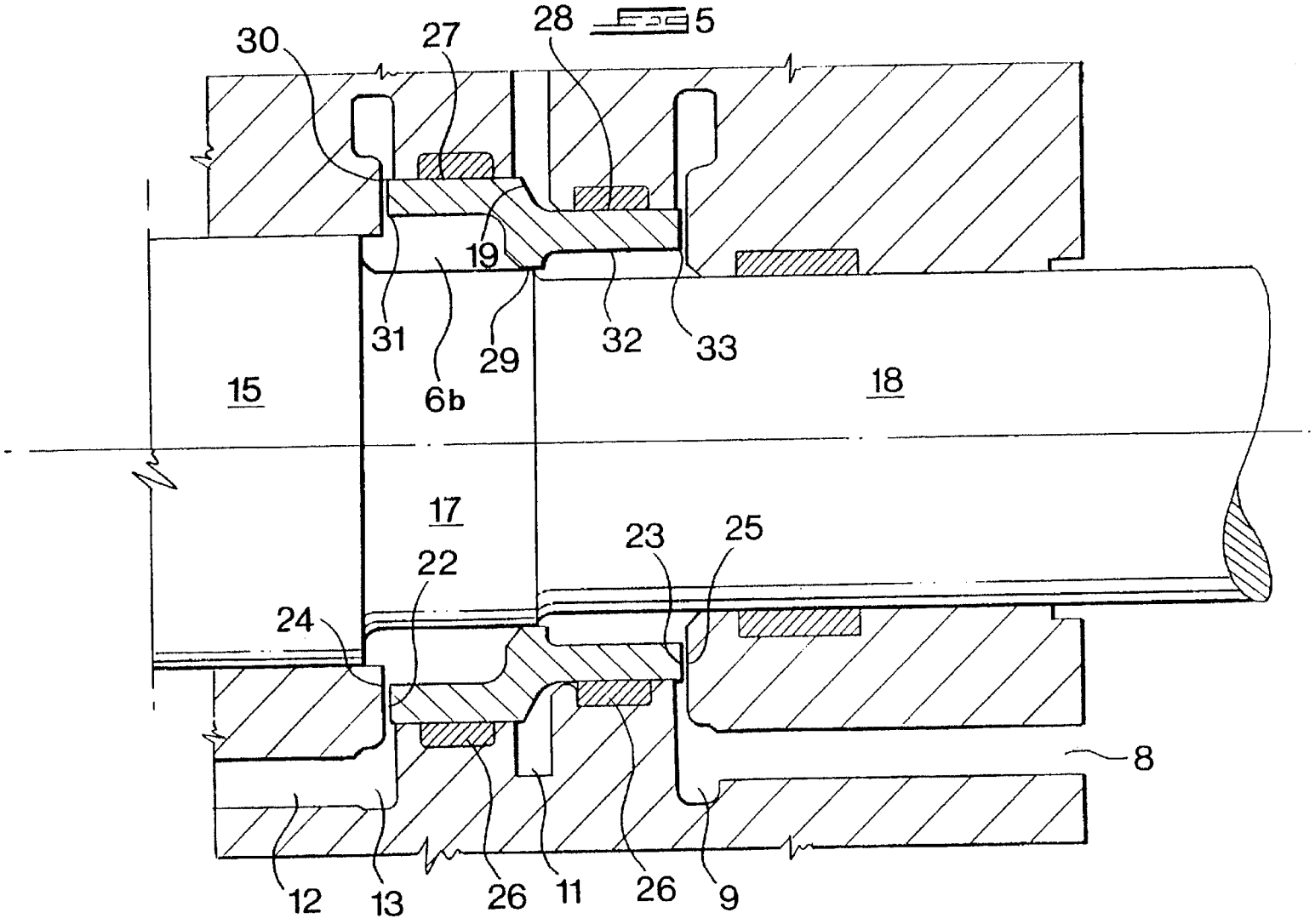
FIG. 5 shows an enlarged cross-sectional view illustrating the poppet valve and return chamber of the reciprocating mechanism.

With reference to FIG. 1 and FIG. 5 the illustrated embodiment is shown to include a housing 1, a piston 2 and a poppet valve 3.

The housing includes a supply chamber 4 formed by a supply zone **4*a* and an intermediate zone 4*b*, a return chamber 6, an inlet port 7 leading into the supply chamber 4, circumferentially spaced exhaust ports 8 (only ore visible in the drawings) which are connected to the return chamber 6 by an annular exhaust collector cavity 9, a passage 10 leading from the supply chamber 4 to an annular cavity 11 around the poppet valve 3, and circumferentially spaced passages 12 (only one visible in the drawings) leading from the intermediate zone 4*b* to an annular cavity 13 which communicates with the return chamber 6. The housing also includes two valve seats 24 and 25 (FIG. 5) at the ends of the return chamber. Pressurized hydraulic fluid is supplied to the illustrated mechanism via the inlet port 7**.

The piston 2 includes four round cylindrical sections 14, 15, 17 and 18 with different diameters. Shoulders between the cylindrical sections form lands which provide the various piston areas required for the operation of the mechanism. The piston 2 is guided for reciprocal motion in the housing 1 by seal bearings 20.

The housing defines an annular constriction 21, between the supply and intermediate zones **4*a* and 4*b*, which acts as a switching seal. As subsequently described with reference to FIG. 3, the section 15 of the piston makes sealing engagement with the switching seal 21 for a short period of time during its reciprocating movement, and it is only during this period of time that the supply and intermediate zones 4*a* and 4*b* of the supply chamber 4 are hydraulically isolated from one another. When the cylindrical section 15 is not engaged with the switching seal 21, the supply zone 4*a* and the intermediate zone 4*b*** are in communication and effectively form one chamber.

Referring to FIG. 5, the poppet valve 3 has its inner surface radially spaced from the cylindrical sections 17 and 18. The outer surface of the valve 3 is stepped to form portions 27 and 28 which are supported in seal bearings 26 on either side of the annular cavity 11 to provide a hydraulically exposed land 19 which is permanently exposed to pressurized hydraulic fluid in the cavity 11 via the passage 10. The valve 3 has end faces 22 and 23 which seat on the valve seats 24 and 25 respectively, and is movable between the two valve seats. The valve 3 controls the supply of pressurized hydraulic fluid to, and exhaust fluid from, the return chamber 6.

Figure 3:
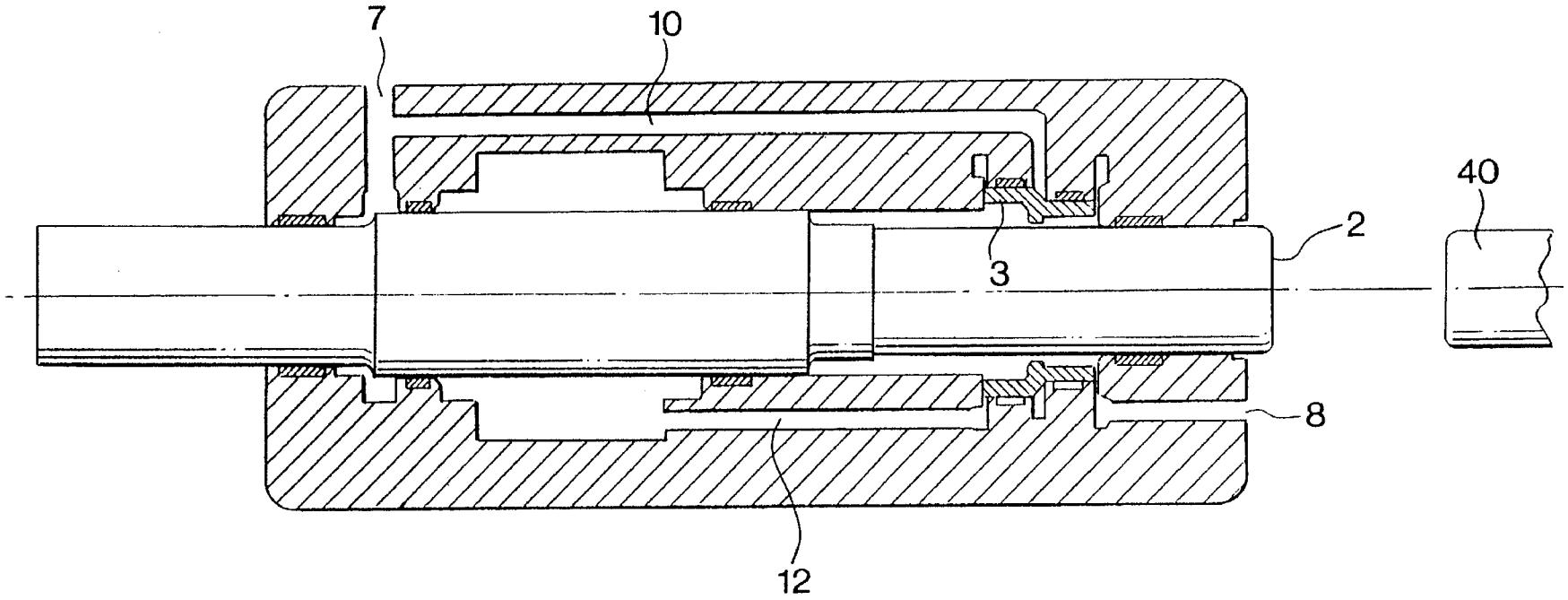
FIG. 3 shows a cross-sectional view of the mechanism with the piston at the end of its return stroke.

In a first position of the popper valve, when the valve face 23 is seated on the valve seat 25, the exhaust passages 8 are shut off from the return chamber 6 and the intermediate zone **4*b* is in fluid communication with the return chamber 6 via the passages 12. This position of the valve is illustrated in FIG. 1. In a second position of the popper valve, when the valve face 22 is seated on the valve seat 24, the exhaust collector cavity 9 and the exhaust passages 8 are in fluid communication with the return chamber 6, and the passages 12 from the intermediate zone 4*b* are isolated from the return chamber 6. This position of the valve is illustrated in FIG. 3**.

When the valve is moving between its first and second positions, the passages 12 are momentarily in fluid communication with the exhaust passages 8 through the return chamber 6, since there is a small radial clearance between the cylindrical section 17 of the piston and an annular constriction defined by a projection 29 on the internal surface of the valve. This situation is illustrated in FIG. 5.

Also shown in FIGS. 1 to 4 is the rear end of a drill steel 40 against which the piston 2 impacts periodically during operation. The manner in which the drill steel is slidably chucked into the housing is not illustrated.

The pressurized hydraulic fluid is typically mine grade water at a pressure between 10 and 20 MPa.

The operation of the mechanism will now be described assuming that the piston 2 has just struck the drill steel 40 at the end of a forward stroke. The piston 2 and the valve 3 are in the positions shown in FIG. 1. The face 23 of the valve 3 is seated on the valve seat 25. With the valve 3 in this position the return chamber 6 is in fluid communication with the intermediate zone **4*b* through the passages 12. With the cylindrical section 15 disengaged from the switching seal 21, the intermediate zone 4*b* and the supply zone 4*a* are in fluid communication with one another. Thus the supply chamber 4 and the return chamber 6 are both supplied with pressurized hydraulic fluid. As the diameter of the cylindrical section 18 is less than the diameter of the cylindrical section 14, the pressure of the hydraulic fluid creates a resultant force on the piston 2 in a direction away from the drill steel 40. The piston 2 therefore accelerates away from the drill steel 40** on a return stroke.

As stated previously, the stepped outer surface of the valve 3 is supplied with pressurized hydraulic fluid via the passages 10. Also, the inner surfaces and the face 22 of the valve 3 are in contact with pressurized hydraulic fluid in the return chamber 6. The valve 3 is thus surrounded by pressurized hydraulic fluid on all of its surfaces except for the valve face 23 which is seated on the valve seat 25. This gives rise to a resultant force on the valve 3 which tends to hold it against the valve seat 25. As also stated previously, the valve is now in its first position.

Figure 2:
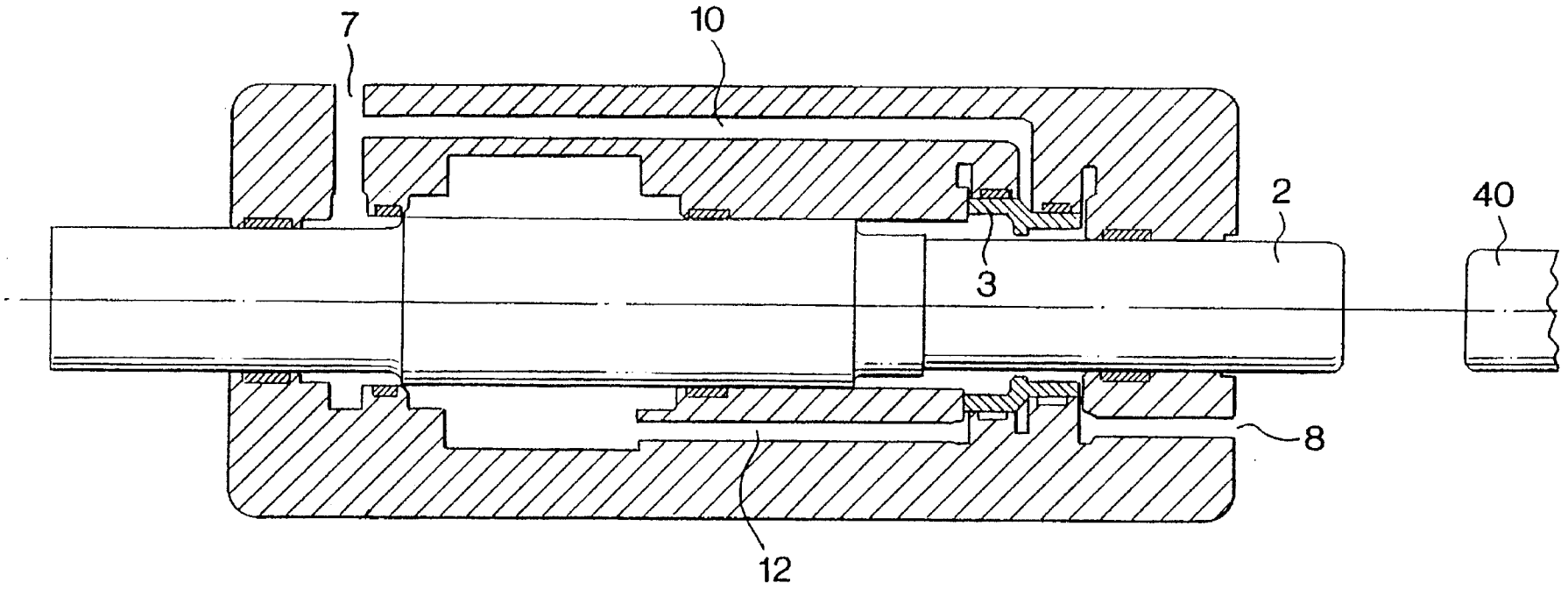
FIG. 2 shows a cross-sectional view of the reciprocating mechanism with the piston nearing the end of its return stroke, i.e. a stroke in the first direction.

The piston 2 accelerates away from the drill steel 40, on the return stroke, until the cylindrical section 15 engages the switching seal 21, as illustrated in FIG. 2. When the cylindrical section 15 engages the switching seal 21, the piston 2 continues moving away from the drill steel 40 due to its inertia. This continued movement of the piston 2 increases the combined volume of the intermediate zone **4*b* and the return chamber 6, which communicate with one another via the passages 12**, causing the pressure in this zone and chamber to decrease rapidly.

As the pressure in the intermediate zone **4*b* and in the return chamber 6 decreases, the forces acting on the face 22 and the inner surfaces of the valve 3 decrease accordingly. The stepped outer surface of the valve 3 is still under the influence of pressurized hydraulic fluid via the passages 10. The pressure differential across the valve 3 now causes a resultant force on the valve towards the valve seat 24. The valve therefore leaves the seat 25 and accelerates towards the seat 24. The magnitude of the accelerating force, the mass of the valve 3 and the stroke of the valve 3 between the seats 24 and 25 are chosen so that the face 22 of the valve 3 reaches the valve seat 24 in a very short time compared with the period of one cycle of the piston 2. When the face 22 of the valve 3 reaches the valve seat 24** it is held there by the resultant hydraulic force acting on it. The valve is now in its second position.

FIG. 3 illustrates the piston 2 momentarily stationary at the end of its return stroke, with the valve 3 in the second position. With the valve 3 in this position, the return chamber 6 is in fluid communication with the ambient atmosphere via the exhaust collector cavity 9 and the exhaust passages 8. The intermediate zone **4*b* is isolated from the return chamber 6 by the valve 3 which effectively closes the passages 12. The return chamber 6 is thus at atmospheric pressure while the supply zone 4*a* remains supplied with pressurized hydraulic fluid which applies a driving force to the piston, urging it to the right in FIG. 3. The piston 2 thus accelerates towards the drill steel 40** on the next forward stroke.

As the piston 2 moves towards the drill steel 40 on the forward stroke, the cylindrical section 15 separates from the switching seal 21, and the intermediate zone 4b is rapidly recharged with pressurized hydraulic fluid from the supply zone 4a. This has no effect on the poppet valve 3 because there are no transverse surfaces of the valve exposed to the fluid pressure in the passages 12. The hydraulic fluid in the return chamber 6 is driven by the piston through the radial gap which exists between the piston 2 and the valve 3, defined by the cylindrical section 18 and the valve projection 29, and out through the exhaust passages 8. This radial gap and the exhaust passages 8 are sized so that no significant back-pressure is built up in the return chamber 6 during this part of the movement of the piston.

Figure 4:
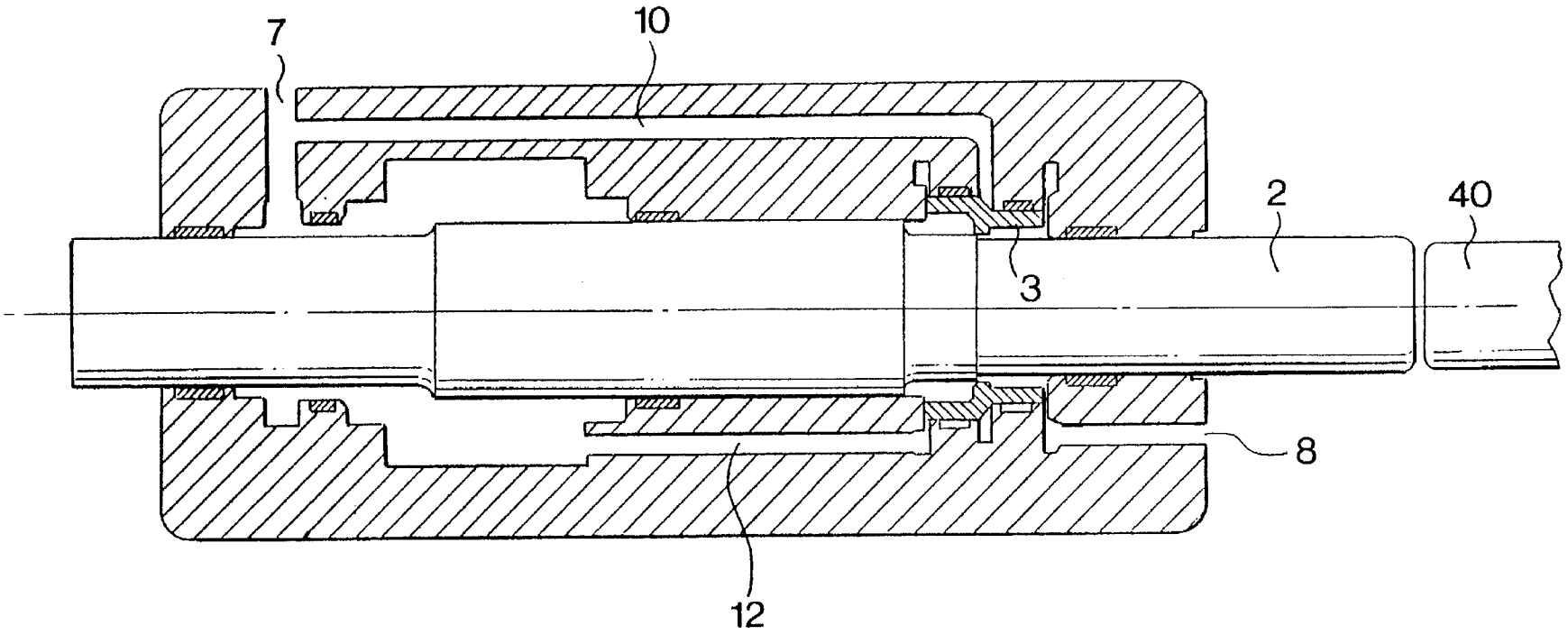
FIG. 4 shows a cross-sectional view of the mechanism with the piston nearing the end of its forward stroke, just prior to striking a drill steel.

The piston 2 continues moving towards the drill steel 40 on the forward stroke. Shortly before the piston 2 strikes the drill steel 40, the cylindrical section 17 enters the annular constriction defined by the valve projection 29, as shown in FIG. 4, and the radial gap between the piston 2 and the valve 3 is greatly reduced. The piston 2 is now moving at its maximum speed towards the drill steel 40, and it is nearing the end of its forward stroke. The hydraulic fluid in that portion of the return chamber indicated by the numeral 6b in FIG. 5 therefore has to be exhausted through the small radial gap between the cylindrical member 17 and the valve projection 29. This gap is small enough to result in the pressure in the return chamber portion 6b building up rapidly to a high value. The elevated pressure in the portion 6b acting on the valve 3 gives rise to a force on the valve acting in the direction towards the valve seat 25, i.e. to the right in FIG. 4. This force is significantly higher than the force holding the valve against the valve seat 24 during the forward stroke and the valve 3 accordingly accelerates to the right, i.e. towards its first position. As the valve face 22 separates from the valve seat 24, the return chamber 6 is once again placed in fluid communication with the intermediate zone 4b via the passages 12. The return chamber 6 is therefore supplied with pressurized hydraulic fluid which assists in moving the valve 3 across to the valve seat 25. When the valve 3 moves away from the valve seat 24 towards the valve seat 25, pressurized hydraulic fluid is able to escape through the gap between the piston 2 and the valve projection 29 and then through the exhaust passages 8. The valve 3 moves rapidly to the right until the valve face 23 reaches the valve seat 25 and the loss of pressurized hydraulic fluid through the passages 8 ceases. The valve is now once again in its first position and, after the piston 2 has struck the drill steel 40, the cycle repeats itself as described above.

It will be appreciated that many modifications of the above embodiment are possible. For example, the diameter of the cylindrical section 15 need not be constant throughout. With a further step in diameter in this section, the characteristics of movement of the piston as the section 15 leaves the switching seal 21 can be varied. Also, the diameter of the valve at the location 30 may differ from the diameter of the valve where it engages the relevant seal bearing 26. Similarly, the diameter of the valve at the location 33 may differ from the diameter of the valve at the location 32.

It should also be noted that it is not necessary for the section 15 of the piston to make sealing engagement with the constriction defined by the switching seal 21. There may in fact only be an annular constriction at the location of the seal 21, the constriction being dimensioned, even in the absence of a seal with the piston, to give rise to similar hydraulic effects to those mentioned above.

In the above description the strokes of the piston are referred to as the "forward" and "return" strokes and it will be understood that these references are used to facilitate description of the movement of the piston relative to the drill steel and are not limiting on the scope of the invention. Thus in applications of the hydraulic reciprocating mechanism other than in rock drills, the "forward" and "return" strokes of the piston will merely refer to movement of the piston in opposite directions.

Obviously, numerous modifications and variations of the present invention are possible in light of the above teachings. It is therefore to be understood that within the scope of the appended claims, the invention may be practiced otherwise than as specifically described herein.

I claim:

1. An hydraulic reciprocating mechanism comprising:

housing;

a piston located reciprocably in the housing and defining, with the housing, a supply chamber and a return chamber, the return chamber having respective first and second ends and the piston presenting exposed, differential piston areas on which hydraulic forces act, during, operation of the mechanism, to cause reciprocation of the piston;

an inlet to the supply chamber for pressurized hydraulic fluid;

an exhaust outlet from the return chamber;

an interconnecting passage extending between the supply chamber and the return chamber; and a single poppet valve which is located reciprocably in the return chamber for movement, under the influence of hydraulic forces, between:

a first position in which the poppet valve seats against the first end of the return chamber so as to close the exhaust outlet and open the interconnecting passage to admit hydraulic fluid from the supply chamber to the return chamber with the result that the hydraulic fluid in the return chamber drives the piston in a first direction; and a second position in which the poppet valve seats against the second end of the return chamber so as to close the interconnecting passage and open the exhaust outlet to allow hydraulic fluid to be exhausted from the return chamber by the piston as the piston is driven a second direction, opposite to the first direction, by hydraulic fluid in the supply chamber.

2. A mechanism according to claim 1 wherein the arrangement is such that the poppet valve is moved, by hydraulic forces acting on it, from its first position to its second position as the piston approaches the end of a stroke in the first direction and from its second position to its first position as the piston approaches the end of a stroke in the second direction.

3. A mechanism, according to claim 2 wherein the poppet valve is annular in shape, with inner and outer surfaces, and surrounds the piston, the outer surface of the poppet valve being exposed continuously to the pressure of hydraulic fluid at the inlet being shaped such that the poppet valve experiences an hydraulic force, due to the pressure of hydraulic fluid at the inlet, tending to move it from its first position to its second position.

4. A mechanism according to claim 3 wherein:

the supply chamber includes a supply zone in direct communication with the inlet and an intermediate zone connected to the return chamber by the interconnecting passage, the housing defines an annular constriction between the supply and intermediate zones, and a section of the piston is arranged to make a close fit with the annular constriction as the piston approaches the end of its stroke in the first direction, with the result that, with further movement of the piston in the first direction, there is a reduction in hydraulic pressure in the intermediate zone of the supply chamber and in the return chamber, such pressure reduction causing a pressure differential across the poppet valve which urges the poppet valve from its first position to its second position.

5. A mechanism according to claim 4 wherein:

the inner surface of the poppet valve defines an annular constriction about the piston with respective portions of the return chamber being defined between the first end of the return chamber and the constriction and between the second end of the return chamber and the constriction, and a section of the piston makes a close fit in the constriction when the piston approaches the end of its stroke in the second direction, with the result that hydraulic pressure increases in that portion of the return chamber defined between the second end thereof and the constriction, such pressure increase urging the poppet valve to move from its second position to its first position.

6. A mechanism according to any one of claims 1–5 wherein the mechanism is incorporated in a rock drill used to apply repeated impacts to an end of a drill steel with the piston being arranged to strike the end of the drill steel on its stroke in the second direction and to withdraw from the end of the drill steel on its stroke in the first direction.

7. An reciprocating mechanism which is powered by pressurized water and which comprising:

a housing;

a piston located reciprocably in the housing and defining, with the housing, a supply chamber and a return chamber, the return chamber having respective first and second ends and the piston presenting exposed, differential piston areas on which forces generated by the water act, during operation of the mechanism, to cause reciprocation of the piston;

an inlet to the supply chamber for pressurized water;

an exhaust outlet from the return chamber;

an interconnecting passage extending between the supply chamber and the return chamber; and a single poppet valve which is located reciprocably in the return chamber for movement, under the influence of force of pressurized water, between:

a first position in which the poppet valve seats against the first end of the return chamber so as to close the exhaust outlet and open the interconnecting passage to admit water from the supply chamber to the return chamber with the result that the water in the return chamber drives the piston in a first direction; and a second position in which the poppet valve seats against the second end of the return chamber so as to close the interconnected passage and open the exhaust outlet to allow water to be exhausted from the return chamber by the piston as the piston is driven a second direction, opposite to the first direction, by water in the supply chamber, wherein:

the arrangement is such that the poppet valve is moved, by force of pressurized water acting on it, from its first position to its second position as the piston approaches the end of a stroke in the first direction and from its second position to its first position as the piston approaches the and of a stroke in the second direction, the poppet valve is annular in shape, with inner and outer surfaces, and surrounds the piston, the outer surface of the poppet valve being exposed continuously to the pressure of water at the inlet and being shaped such that the poppet valve experiences a force, due to the pressure of water at the inlet tending to move it from its first position to its second position, the supply chamber includes a supply zone in direct communication with the inlet and an intermediate zone connected to the return chamber by the interconnecting passage, the housing defines an annular constriction between the supply and intermediate zones, a section of the piston is arranged to make a close fit with the annular constriction as the piston approaches the end of its stroke in the first direction, with the result that, with further movement of the piston in the first direction, there is a reduction in water pressure in the intermediate zone of the supply chamber and in the return chamber, such pressure reduction causing a pressure differential across the poppet valve which urges the poppet valve from its first position to its second position, the inner surface of the poppet valve defines an annular poppet valve constriction about the piston with respective portions of the return chamber being defined between the first end of the return chamber and the poppet valve constriction and between the second end of the return chamber and the poppet valve constriction, and a section of the piston makes a close fit in the poppet valve constriction when the piston approaches the end of its stroke in the second direction, with the result that water pressure increases in that portion of the return chamber defined between the second end thereof and the poppet valve constriction, such pressure increase urging the poppet valve to move from its second position to its first position.

8. A reciprocating mechanism which is powered by pressurized water and which comprises:

housing;

a piston located reciprocably in the housing and defining, with the housing, a supply chamber and a return chamber, the return chamber having respective first and second ends and the piston presenting exposed, differential piston areas on which forces generated by the pressurized water act, during operation of the mechanism, to cause reciprocation of the piston;

an inlet which is connectable to a supply of pressurized water and which delivers the pressurized water to the supply chamber;

an outlet for exhausting water from the return chamber; and an interconnecting passage extending between the supply chamber and the return chamber;

a single poppet valve which is located reciprocably in the return chamber for movement, under the influence of forces generated by the pressurized water, between:

a first position in which the poppet valve seats against the first end of the return chamber so as to close the exhaust outlet and open the interconnecting passage to admit pressurized water from the supply chamber to the return chamber with the result that the pressurized water in the return chamber drives the piston in a first direction, and a second position in which the poppet valve seats against the second end of the return chamber so as to close the interconnecting passage and open the exhaust outlet to allow water to be exhausted from the return chamber by the piston as the piston is driven a second direction, opposite to the first direction, by pressurized water in the supply chamber.

* * * * *